United States Patent [19]

Pilolla et al.

[11] Patent Number: 4,938,384

[45] Date of Patent: Jul. 3, 1990

[54] LIQUID DISPENSER

[75] Inventors: Joseph J. Pilolla, Elmhurst; John R. Wilson, Naperville; Edward M. Jones, Hoffman Estates; Richard A. Kamysz, Roselle, all of Ill.

[73] Assignee: Sloan Valve Company, Franklin Park, Ill.

[21] Appl. No.: 297,594

[22] Filed: Jan. 17, 1989

[51] Int. Cl.[5] ..... B67D 5/00

[52] U.S. Cl. ..... 222/52; 222/63; 222/639; 222/333; 222/566; 250/221; 417/417

[58] Field of Search ..... 141/351; 222/52, 63, 222/639, 333, 566; 250/221; 417/417

[56] References Cited

U.S. PATENT DOCUMENTS

| | | | |
|---|---|---|---|
| 2,446,109 | 7/1948 | Scarry | 222/63 |
| 3,327,901 | 6/1967 | Yerkovich | 222/639 |
| 3,419,188 | 12/1968 | Matchett | 250/221 |
| 3,480,787 | 11/1969 | Johansen | 250/221 |
| 4,306,843 | 12/1981 | Arai | 417/417 |
| 4,518,105 | 5/1985 | Kuchens et al. | 222/333 |
| 4,722,372 | 2/1988 | Hoffman et al. | 222/52 |
| 4,767,922 | 8/1988 | Stauffer | 250/221 |

*Primary Examiner*—H. Grant Skaggs

*Attorney, Agent, or Firm*—Kinzer, Plyer, Dorn, McEachran & Jambor

[57] ABSTRACT

An electrically operable liquid soap dispenser responsive to the presence of a user dispenses a measured amount of soap on demand. It has a spout with a fluid conduit therein connecting a soap reservoir and a nozzle. A pump draws soap from the reservoir during a stroke of its plunger and depending on the embodiment, ejects a measured amount of soap during a subsequent plunger downstroke or upstroke. At least one check valve regulates the flow of soap from the reservoir to an orifice at the nozzle. The soap path from the reservoir to the nozzle is kept full of soap so that a single cycle of the pump is sufficient to eject the desired amount of soap. The orifice is sized and shaped so as to prevent dripping while maintaining soap at the nozzle ready to be ejected. A light beam emitter and detector control operation of the pump.

34 Claims, 3 Drawing Sheets

LIQUID DISPENSER

BACKGROUND OF THE INVENTION

The present invention relates to automatic soap dispensers which eject a measured amount of liquid soap upon the request of a user without requiring the user to touch any part of the dispenser. It is particularly directed to such a dispenser having a positive displacement plunger type pump and a dispensing nozzle having no moving parts.

Automatic soap dispensers are known. They have general application to public restrooms in hotels, theatres, airports, and the like. Usually operated by light, sound or proximity sensors, such devices include some form of vibratory pump which, upon energization, cycles for a preset period. Such devices also usually include some form of dispensing nozzle which usually includes a shut off valve. These valves are prone to clogging which renders the device unusable or causes costly leaks.

A desirable feature in a dispenser of the type described is that it be responsive to a demand for soap without delay occasioned by priming a void between the pump and the nozzle. This requires soap to be present at the nozzle and that the pump be effective to move the soap out of the nozzle immediately on demand. This condition of the dispenser cannot be allowed to result in soap dripping from the nozzle. Means must be provided to reliably contain the soap just inside the nozzle as it awaits the next operation of the dispenser.

SUMMARY OF THE INVENTION

The soap dispenser of the present invention accommodates the need for immediate response to demand and maintains a continuous column of soap between the pump outlet and the discharge nozzle without moving parts. It handles the somewhat incompatible requirements of dripless, immediate response in one embodiment by carefully matching the soap viscosity with the size and shape of the orifice in the nozzle. The resulting configuration allows the surface tension of the soap to offset the force of gravity tending to pull a soap droplet out of the orifice. The orifice is a generally oval-shaped channel having a depth to length to width ratio of about 5:4:1. It has been found that with a depth of about one quarter of an inch and a soap viscosity of about 1.5 centipoise, dripless, immediate response can be achieved.

In another embodiment, dripless, immediate response is achieved by the positioning of the nozzle in the spout and the configuration of the nozzle itself. The nozzle is positioned in the spout such that its central axis defines an angle of approximately 60° to the horizontal. The nozzle is provided with a conical, diverging rim portion having an adhesion surface about its inner periphery. The rim portion diverges at about a 45° angle from the central axis of the nozzle. The diverging rim portion and the position of the nozzle with respect to the spout provide immediate, dripless response.

The present invention has a solenoid operated reciprocal plunger pump supplying soap from a reservoir to a spout having a nozzle at one end. The pump is controlled by a detector circuit comprising a light beam emitter and detector. When the light beam from the emitter to the detector is broken, a pulse signal is sent to activate the solenoid of the pump.

The pump has a plunger sealed in a housing with a central passage through the plunger. The plunger reciprocates in a duty cycle including an upstroke and a downstroke. Check valves are provided in the housing and central passage to regulate the flow of soap through the pump. In one embodiment, when the pump is activated by the detector circuit, the plunger moves through an upstroke. The resulting pressure drop in the housing draws soap into the housing from the reservoir. The subsequent donwstroke of the plunger drives soap through the central passage to the spout where it displaces some of the soap already in the spout such that a continuous column of soap extends between the pump outlet and the discharge nozzle. As a result, the soap at the nozzle is ejected.

In another embodiment, when the pump is activated by the detector circuit, the plunger, which includes a piston at its lower end, moves through an upstroke creating a vacuum in the housing beneath the piston, thereby drawing soap from the reservoir. At the same time, as the plunger moves upwardly, the soap in the housing above the piston is forced through the central passage of the plunger to the spout where it displaces soap already in the spout such that a continuous column of soap extends from the pump outlet and the discharge nozzle thereby necessarily ejecting a measured amount of soap from the nozzle. A subsequent downstroke creates a vacuum in the housing above the piston forcing the soap located by the upstroke beneath the piston to relocate above the piston, such that the dispenser is ready to eject soap upon reactivation by the detector circuit.

DETAILED DESCRIPTION OF THE INVENTION

Figure 1:
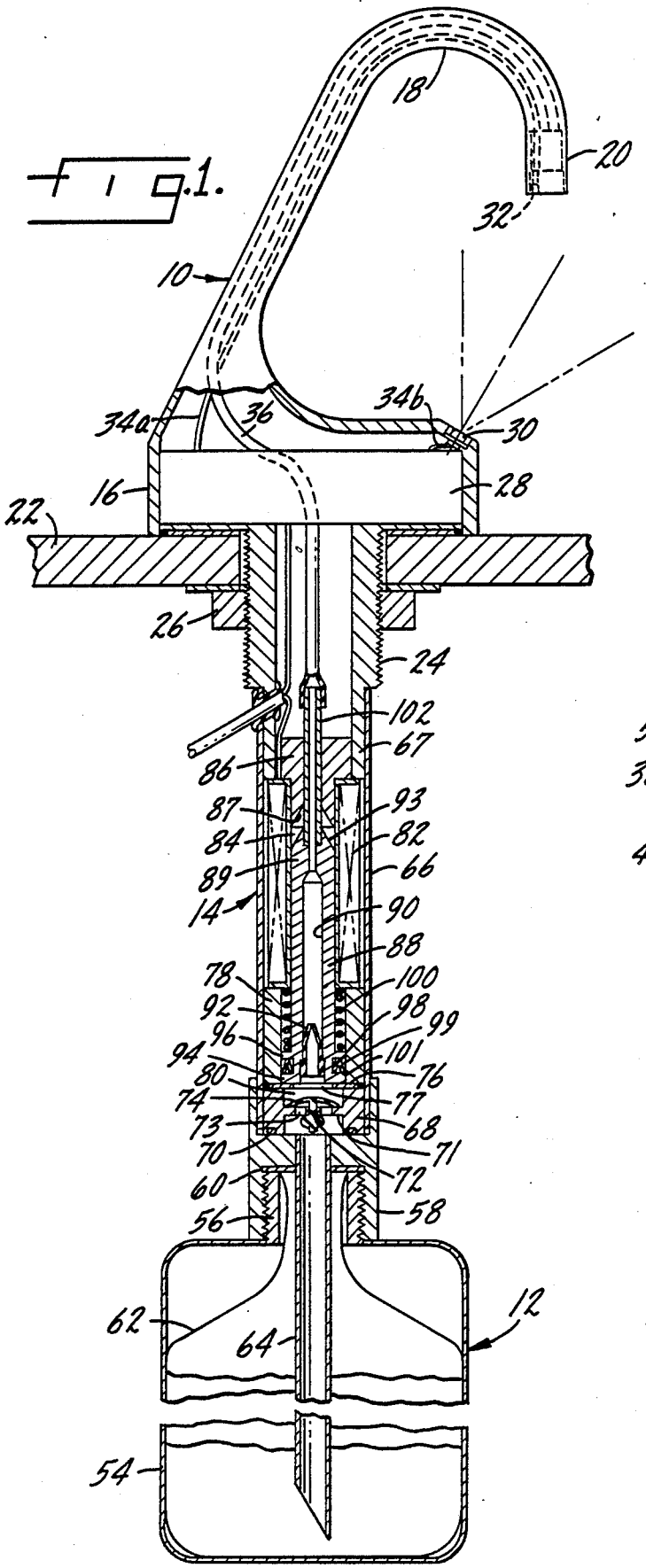
FIG. 1 is a side view of one embodiment of the liquid soap dispenser of the present invention with parts in section and portions broken away for clarity.

FIGS. 1 through 4 illustrate one embodiment of the soap dispenser of the present invention. It has three main parts: a spout 10, a liquid soap reservoir 12 and an electrically-actuated pump 14 providing fluid communication between the reservoir 12 and spout 10.

Referring to the structure of the dispenser, spout 10 is an integral member having a base 16 and a neck 18 terminating at a downwardly-directed tip 20. The base 16 is adapted for mounting on a surface 22 by means of an upper fitting 24 and a lock nut 26. While the base 16 is shown mounted to a horizontal surface 22, obviously it could be mounted on a vertical wall or other suitable support member with appropriate modifications of the neck's shape. The base 16 is hollow and has a control circuit board 28 mounted in it. The circuit board in turn mounts a light beam emitter indicated schematically at 30. A light beam detector 32 is mounted in the tip 20 of the spout. The emitter and detector are connected to the circuit board 28 by conductors shown schematically at 34*a* and 34*b*. These conductors could, in the alternative, be fiber optic cables with the emitter and detector mounted in the board 28.

Figure 2:
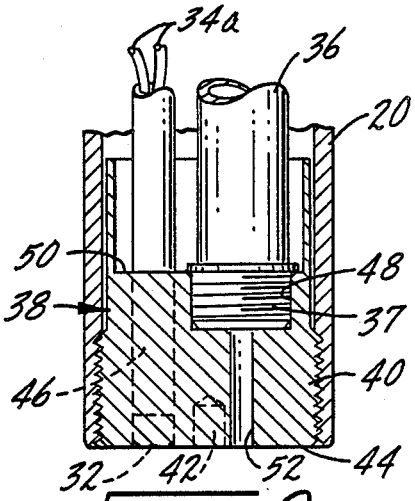
FIG. 2 is an enlarged section through the end of the spout of the dispenser shown in FIG. 1, showing the nozzle installed in the spout.

A fluid conduit 36 extends through a hollow portion of the upper fitting 24 to the interior of the spout 10. The conduit 36 is a flexible tube which runs through the base and neck portions of the spout 10, terminating at the spout tip 20. As best seen in FIG. 2, the end of the conduit 36 has a fitting 37 which threads into a receptable in a nozzle 38.

Figure 3:
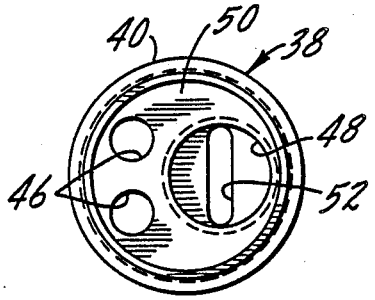
FIG. 3 is an end view of the interior face of the nozzle of FIG. 1.
Figure 4:
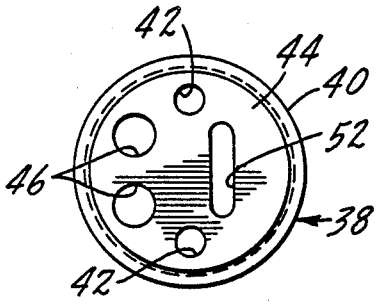
FIG. 4 is an end view of the exterior face of the nozzle of FIG. 1.

The nozzle has a body member 40 with exterior threads for engagement with the interior threads of the spout tip 20. A pair of recesses 42 in the outer face 44, as shown in FIGS. 2 and 4, provide access for a tool or wrench to be used when inserting the nozzle 38 into the tip 20. As seen in FIGS. 2–4, a pair of sockets 46 extends through the body 40 for receiving one or more light beam detectors, such as that shown schematically at 32. The electronic sensing used in the illustrated embodiment is of the break beam type. That is, the circuit to the actuating solenoid is energized when the light beam from emitter 30 is shielded from detector 32. A reflective system could also be used, with the emitter 30 and detector 32 mounted in sockets 46 and connected by electrical conductors to board 28. The actuating solenoid would in this instance be energized when the detector 32 sensed reflected light from the hand of a user placed under the emitter 30. It would also be within the scope of the invention to place both the emitter 30 and the detector 32 on board 28 and communicate to the sockets 46 with fiber optic cables.

A receptacle 48 formed on the inner face 50 of the nozzle 38 receives the fitting 37 of the fluid conduit 36. The receptacle 48 is in fluid communication with an orifice 52. The shape of the orifice 52 plays an important role in imparting the dripless immediate response quality to the dispenser. The oval shape shown has been found effective in preventing soap from dripping out of the orifice 52. In particular, the relatively long and narrow shape allows the surface tension of the soap to offset the force of gravity. It has been found that liquid soap typically has a viscosity of about at least 1.5 centipoise. Defining the length of the orifice 52 as the long dimension of the oval shape and the width as the narrow dimension of the oval shape, a ratio of about 4 to 1 of the length to width is desirable. The depth of the orifice, i.e., the distance from the outer face 44 to the bottom of the receptable 48, also plays a role in providing the dripless feature. A suitable depth to width ratio has been found to be about 5 to 1. Specifically, a nozzle having an orifice depth of about 0.25 inches, a length of about 0.2 inches, and a width of about 0.05 inches has been found to be suitable when the liquid soap viscosity is at least about 1.5 centipoise. It will be understood that these dimensions are for reference purposes, and they could be different if a different viscosity soap were used. For example, a higher viscosity soap could be used if a more powerful pump were used.

Looking now at FIG. 1, the liquid soap reservoir 12 includes a container 54 having a neck 56. The neck is threaded into the bottom half of a lower fitting 58. The fitting 58 includes a washer 60 which clamps the upper ends of a collapsible bag 62. The bag 62 contains the soap and collapses as soap is withdrawn to prevent air from entering the soap stream. A pickup tube 64 extends from the lower fitting 58 into the soap (not shown) in the bag 62.

Looking now at the pump 14, it includes a cylindrical housing 66 which fits into the top half of the lower fitting 58 and around a collar 67 in the upper fitting 24. Lower annular plug 68 fits into the lower fitting 58 inside the housing 66 and is sealed against the fitting 58 by a seal member 70. The plug 68 has a wall 71 with a hole 72 through its center. An umbrella-type first check valve 74 fits in the hole 72 and covers feed holes 73. A washer 76 rests on top of the plug 68. The washer 76 also has a central opening 77 allowing the passage of soap.

A sleeve 78 sits on top of the washer 76. Together the hollow interiors of the plug 68, washer 76 and sleeve 78 define an entry chamber 80. A solenoid 82 is mounted in the housing, resting on top of the sleeve 78. The solenoid 82 has a central opening 84 extending through it. An upper plug 86 rests on top of the solenoid 82 with a portion extending down into the opening 84. Plug 86 has a central bore and a conical seat 87 facing toward plug 68.

A plunger 88 is disposed in the solenoid opening 84 with a lower portion extending down into the entry chamber 80 defined by sleeve 78. The plunger has an upper annular stem 89 connected to a central passage 90 of the plunger 88. A transfer tube 102 connects the central passage 90 of the plunger to the fluid conduit 36 in the spout 10. A conical limit stop 93 is provided on plug 86 at the juncture of stem 89. The central passage 90 is in fluid communication with the entry chamber 80. The second check valve 92 of the duckbill type is disposed in the central passage 90. The check valve 92 is movable with the plunger 88 which reciprocates in a duty cycle defined by a single upstroke followed by a single downstroke. The lower end of the plunger 88 includes first and second flanges 94 and 96. The flanges 94 and 96 provide seats for a seal 98 and a spring 100, respectively. The seal 98 is a typical scraper or wiper seal having an outer flap 99 facing toward plug 68. The flap includes a scraper edge 101. When the seal moves downward toward the plug 68, scraper edge 101 is forced against the central bore 71 of plug 68 as will be explained. When it moves upward, it slides easily without scraping contact against the bore.

Spring 100 is a compression coil spring sized to force plunger 88 downward after it has been caused to move upward by activation of the solenoid 82. This operation will be described in further detail below.

Initial installation of the soap dispenser includes repeated operation of the pump 14 until the entire fluid conduit 36 and orifice 52 are filled with soap. Thereafter, the soap dispenser is ready for immediate response to the user. That response is generated by the user placing a hand underneath the nozzle 38 to break the light beam from the emitter 30 to the detector 32, thereby generating a signal to the control circuit board 28 which, in turn, outputs a single pulse to the solenoid 82. In the operative embodiment, that pulse is 0.1 seconds in duration.

When the solenoid 82 is energized, the plunger 88 moves through its upstroke. Since the plunger 88 is sealed against the sleeve 78, the upstroke results in a pressure drop in the entry chamber 80. This pressure drop draws liquid soap up the pickup tube 64, through holes 73 and past the first check valve 74, thereby filling the entry chamber 80. During the upstroke, the second check valve 92 is closed so that the column of soap in the central passage 90 cannot flow backwardly into the entry chamber 80. After completion of the upstroke, the solenoid 82 is deenergized, and the spring 100 returns the plunger 88 through a downstroke to its normal, rest position. The plunger 88 downstroke closes the first check valve 74 so the pressure in the entry chamber 80 rises as the plunger 88 moves down. This pressure rise opens the second check valve 92 and forces soap out of the entry chamber 80 into the central passage 90 of the plunger 88. The central passage 90, the transfer tube 102 and fluid conduit 36 were all previously filled with a column of soap. So when additional soap is ejected from the entry chamber 80 into the central passage 90 during a downstroke, the additional soap moves the entire column of soap through the fluid conduit 36, ejecting a measured amount of soap from the orifice 52. In a preferred embodiment, the plunger has a 0.25 inch stroke. This results in 1.55 cubic centimeters of soap being ejected per duty cycle of the pump.

Consideration will now be given to FIG. 5 which schematically illustrates one embodiment of the electronic circuitry that may be employed to effect energization of solenoid 82, in response to the presence of a user, in order to pump a measured quantity of soap from orifice 52. Oscillator 110 produces periodically recurring voltage pulses for intermittently energizing infrared light emitter 30 to transmit, a beam of infrared light pulses to infrared light detector 32 which, in response to the received light pulses, applies a signal to light detection and filtering circuitry 112. This circuitry includes an integrator for effectively filtering out any ambient light received by detector 32 so a reasonably "clean" output signal may be developed representing the detection of a continuous light beam when no user is present and representing the absence of detection or a broken beam when a user is present and interrupts the beam. The undesired ambient light received by detector 32, and contaminating its output signal, may include incandescent, fluorescent, indirect sunlight or any combination thereof.

In the absence of a user breaking the light beam with his or her hands, the output signal of circuitry 112 will not effect operation of the ON delay circuit 113. Hence the remaining circuits in FIG. 5 will not be operated and solenoid 82 will remain deenergized. When the light beam is broken, however, the output signal of circuitry 112 undergoes or experiences an amplitude change to which ON delay circuit 113 responds. That circuit may be of the RC type and ensures that the beam is broken for a predetermined minimum period (for example, 50 miliseconds or ms.) before the output signal of circuitry 112 will be effective. This ON delay renders the system immune to transients. Assuming that the beam is still being interrupted at the end of the 50 milisecond ON delay, circuit 113 outputs a signal to comparator 115 which compares that signal to a reference or threshold voltage to produce a triggering signal for application to monostable or one-shot multivibrator 116. Comparator 115 provides further immunity to the deleterious effects of ambient light in that it will produce a very clean, sharply defined and instantaneously changing triggering signal for actuating multivibrator 116 from its normal operating state or condition to its abnormal condition from which it returns to its normal condition after a predetermined time interval, thereby producing an output pulse having a duration equal to the interval that the multivibrator remains in its abnormal condition. Preferably, for reasons to be understood, multivibrator 116 is constructed so that it will develop, once it is triggered, an ouput voltage pulse having a duration of about 150 miliseconds. As long as the light beam is broken, the output voltage voltage of ON delay circuit 113 will remain the same (namely, a constant voltage level) and the output voltage of comparator 115 will also be constant. Thus, whenever the beam is broken, and regardless of how long it remains interrupted, only a single 150 ms. pulse will be generated by multivibrator 116.

Figure 5:
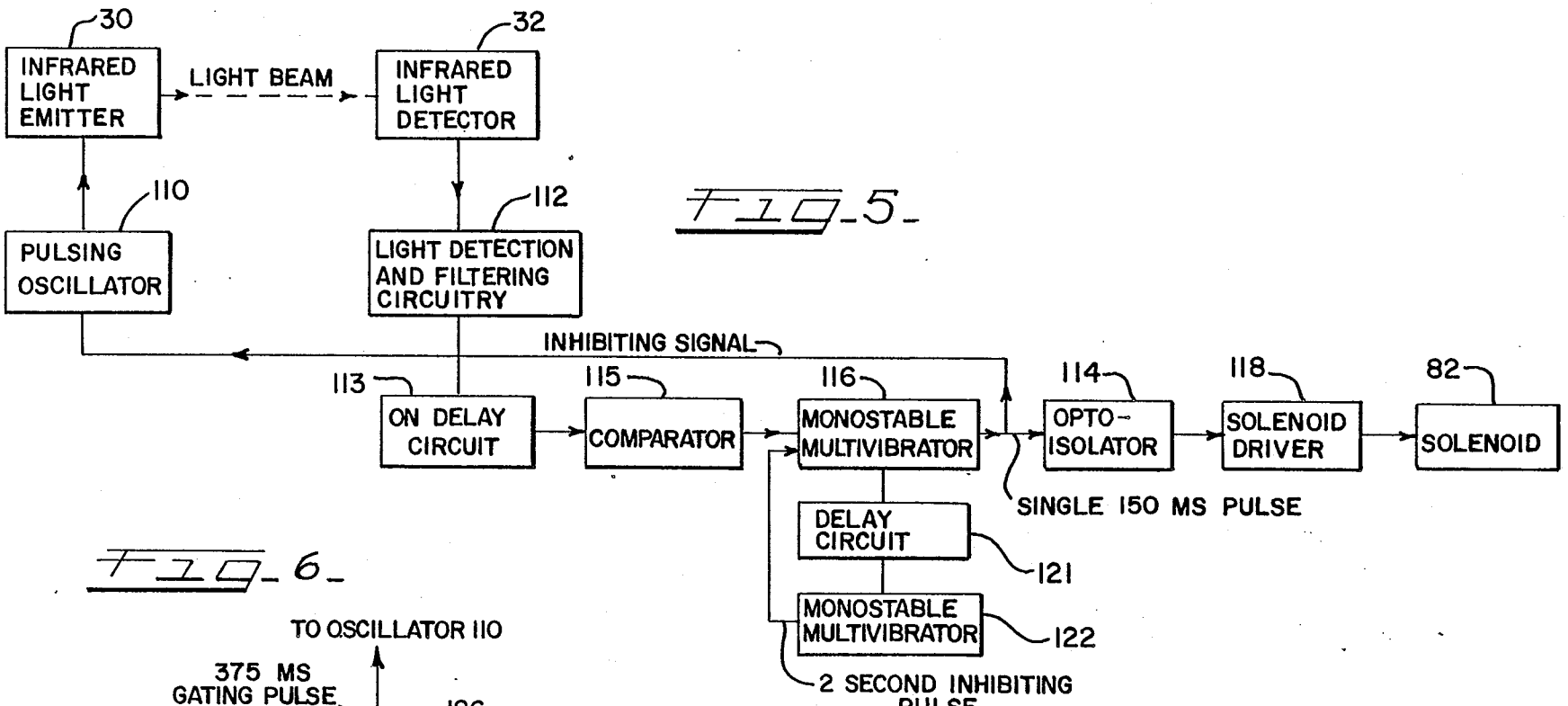
FIG. 5 is a schematic view of one embodiment of the electronic circuitry employed to effect energization of the solenoid used in the present invention.

Preferably, all of the circuits in FIG. 5, with the exception of solenoid driver 118, may be implemented with low voltage (for example, +12 volts d-c) logic and integrated circuits. Solenoid 82, however, should be energized by a much higher voltage, such as +160 volts d-c. Opto-isolator 119 is therefore employed to interfere the low and high voltage circuits. The single 150 ms. pulse, developed each time the beam is broken, energizes the light coupler in opto-isolator 114 and effects operation of solenoid driver 118 to apply the necessary high voltage to solenoid 82 to cause energization thereof. The 150 ms. pulse will be sufficient to move plunger 88 through its upstroke, the solenoid deenergizing at the conclusion of the pulse to cause the plunger to move through its downstroke and discharge a single pulse of soap from orifice 52.

The 150 ms. pulse is also applied to pulsing oscillator 110 to inhibit or turn off the oscillator while the solenoid is being energized. This is done primarily to lessen the load on the power supply for the system to save energy and reduce power requirements.

To prevent solenoid 82 from overheating and burning out in response to repeated energization thereof, which may be caused, for example, when a mischievious person repeatedly moves their hands into and out of the light beam, the operation of the solenoid is effectively locked out for a predetermined minimum time interval following energization. This is accomplished by connecting multivibrator 116 through a delay circuit 121 to another monostable or one-shot multivibrator 122 which produces an output pulse of two seconds duration for application back to multivibrator 116 to inhibit or shut down the operation of that multivibrator for two seconds immediately following the trailing edge of the 150 ms. pulse. With multivibrator 116 disabled, solenoid 82 cannot be energized for at least two seconds and this will afford sufficient time to allow the solenoid to cool down.

Figure 6:
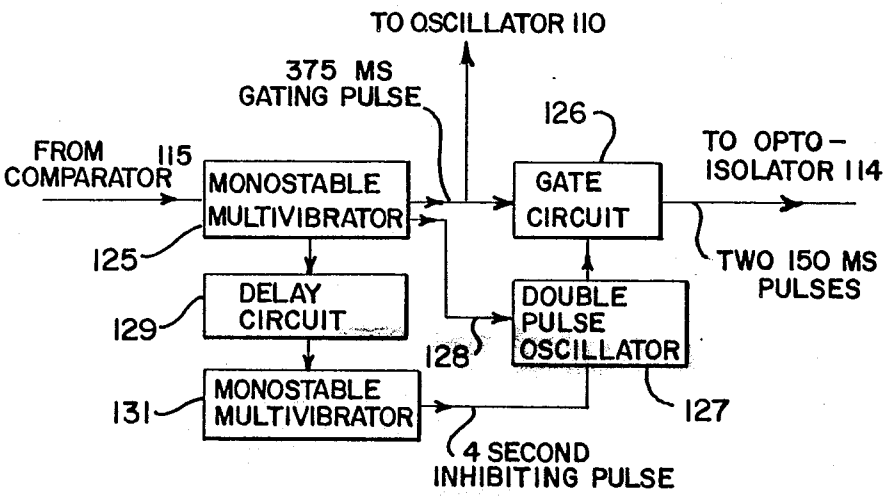
FIG. 6 is a schematic view of a modified embodiment of the electronic circuitry schematically illustrated in FIG. 5.

If it is desired to increase the amount of soap delivered to the user when the beam is broken, the same structure shown in FIGS. 1–4 may be utilized but more than one 150 ms. pulse may be developed to energize solenoid 82 a plurality of times, thereby multiplying the number of soap pulses dispensed to the user. For example, if it is desired to double the amount of soap dispensed by means of the circuitry of FIG. 5, that circuitry may be modified as illustrated by the embodiment of FIG. 6 to develop a series of two separate 150 ms. pulses to actuate the solenoid twice. In FIG. 6, when the beam is interrupted by a user monostable multivibrator 125 responds to the output signal of comparator 115 to produce a gating pulse, having a duration of about 375 miliseconds, for application to one input of gate circuit 126, the other input of which is coupled to the output of double pulse oscillator 127. As indicated by line 128, the operation of oscillator 127 is controlled by, and synchronized to, the 375 ms. gating pulse produced by multivibrator 125 so that the oscillator develops, during the gating pulse and for application to gate circuit 126, a series of two pulses each having a duration of 150 miliseconds with a time separation of 75 miliseconds between the pulses, namely from the trailing edge of the first pulse to the leading edge of the second pulse. In effect, oscillator 127 produces periodically recurring pulses, each of 150 ms. duration, when the oscillator is turned on, and it is turned on by the gating pulse only long enough to produce two 150 ms. pulses. These two 150 ms. pulses will be gated through gate circuit 126 to opto-isolator 119 to effect double pulsing of solenoid 82 so that two pulses of soap will be ejected from the soap dispenser.

The gating pulse generated by multivibrator 125 also inhibits the operation of pulsing oscillator 110 while the solenoid is energized in order to conserve energy, as in the FIG. 5 embodiment. Delay circuit 129 and monostable or one-shot multivibrator 131 function to produce an inhibiting pulse, following the trailing edge of the 375 ms. gating pulse and of four seconds duration, for preventing the operation of solenoid 82, for four seconds after the solenoid has been double pulsed to pump out two soap pulses. After such energization of the solenoid, it is preferred that at least a four second interval be provided to allow the solenoid to cool down before it can be reenergized by a user. This safeguard prevents burn-out of the solenoid.

Figure 7:
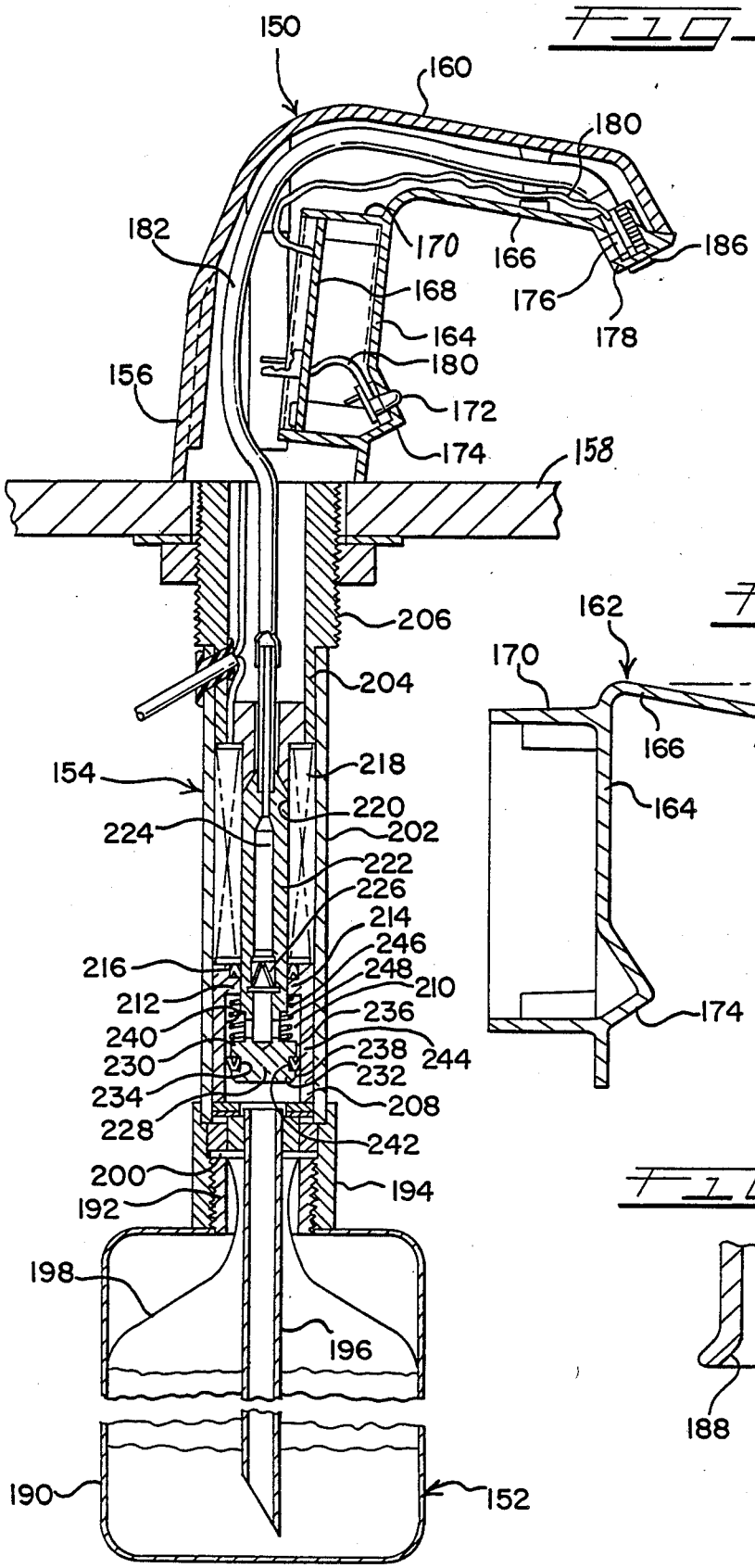
FIG. 7 is a side view of another embodiment of the soap dispenser of the present invention with parts in section and portions broken away for clarity.
Figure 8:
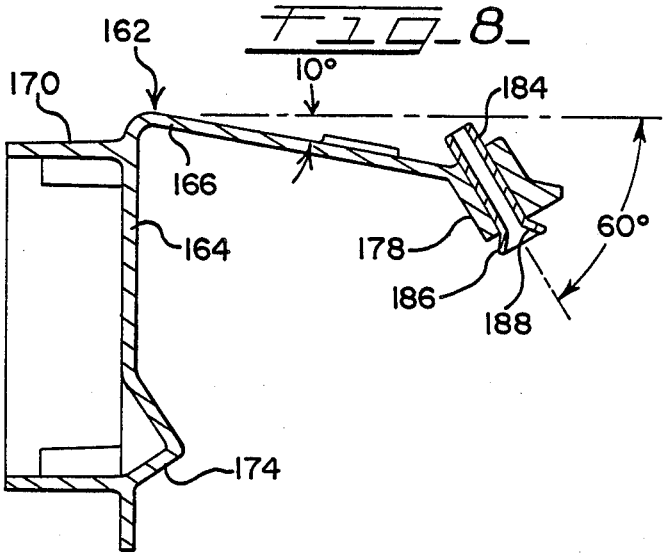
FIG. 8 is a side view of the emitter/detector assembly of the embodiment shown in FIG. 7.
Figure 9:
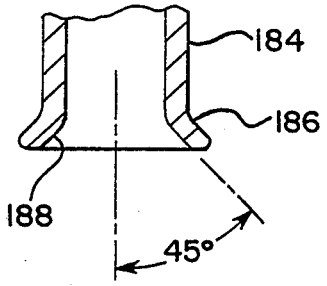
FIG. 9 is a view of the nozzle of FIG. 8.

An alternate embodiment of the soap dispenser is illustrated in FIGS. 7–9. As the embodiment described above, it also includes three main parts: a spout 150, a liquid soap reservoir 152 and an electronically actuated pump 154. The spout 150 includes a base 156 adapted for mounting on a surface 158 in the same manner as described above for the base 16 and a neck 160 which extends outwardly from the base 156. The spout 150 is hollow and the underside of the neck 160 and side of the base 156 adjacent thereto are open to define a singular opening (not shown).

As best shown in FIG. 8, an emitter/detector assembly, generally indicated by the numeral 162, is provided. The assembly 160 includes a first arm 164 and a second arm 166 disposed at approximately 80° to one another. The assembly 162 is adapted to be fit into the opening defined in the spout base 156 and neck 160 and secured thereto by screws or other suitable means. A circuit board 168 is mounted in a box 170 defined on the inner wall of the first arm 164 of the assembly 162 such that when the assembly 162 is fit into the opening, the box 170 is disposed within the spout base 156. The circuit board 168 in turn mounts a light beam emitter 172 which is positioned in a protrusion 174 extending outwardly from the outer wall of the first arm 164. The emitter 172 is directed upwardly at an angle to cooperate with a light beam detector 176 positioned in a support member 178 located at the outer edge of the second arm 166 of the assembly 162. The detector 176 is connected to the circuit board 168 by conductors 180, as is the emitter 172. As in the previously described embodiment, the conductors 180 could be, in the alternative, fiber optic cables with the emitter 172 and detector 176, mounted in the circuit board 168. The arms 164 and 166, box 170, protrusion 174 and support member 178 are of integral construction.

A flexible fluid conduit 182 extends through the spout base 156 and the neck 160 and is fastened to one end of a soap delivery nozzle 184. As best seen in FIG. 8, the nozzle 184 defines a generally cylindrical tube. The end of the nozzle opposite the conduit connection is provided with a generally conical, diverging rim portion 186 defining an adhesion surface 188 about the inner periphery thereof. As shown in FIG. 9, the angle of the rim 186 to the central axis of the nozzle 184 is approximately 45°.

The nozzle 184 is secured in an opening defined through the support member 178 such that the rim portion 186 extends outwardly from the support member 178. The central axis of the nozzle 184 defines an angle of approximately 60° to the horizontal axis of the assembly 162, as shown in FIG. 8.

The configuration of the nozzle rim portion 186 and its positioning with respect to the second arm 166 and the spout neck 160 combine to produce a dripless soap dispenser. As the rim portion 186 diverges, the periphery of the adhesion surface 188 increases, thereby providing a larger surface upon which the soap can cling. When a measured amount of soap is dispensed from the nozzle 184, the surface tension of the remaining soap offsets the force of gravity by expanding along the diverging adhesion surface 188. The undispensed soap is thereby retained by the rim portion 186 until the device is again activated.

The liquid soap reservoir 152 is the same as that described for the previous embodiment and includes a container 190 having a neck 192 which is threaded into the bottom half of a lower fitting 194, a pickup tube 196 extending from the lower fitting 194 into a collapsible bag 198 containing soap and a washer 200 clamping the upper ends of the bag 198.

This embodiment draws soap from the reservoir 152 during an upstroke and ejects a measured amount during the upstroke. The pump 154 includes a cylindrical housing 202, the lower end of which fits into the top half of the lower fitting 194 and the upper end of which fits around a collar 204 in an upper fitting 206 connecting the housing 202 to the spout base 156. An annular sleeve 208 fits into the lower fitting 194 inside the housing 202 and defines a chamber 210 in the lower portion thereof which communicates with the pickup tube 196 of the soap reservoir 152. The upper portion of the sleeve 208 defines an inwardly extending annular flange 212. The flange 212 defines a central opening 214 therethrough and provides a seat for a scraper or wiper seal 216.

A solenoid 218, substantially identical to the solenoid 82 of the previously discussed embodiment, is mounted in the housing 202 and rests on top of the sleeve 208. The solenoid 218 has a central opening 220 extending through it in which a plunger 222 is disposed. The lower portion of the plunger 222 extends down through the flange central opening 214 and into the chamber 210. A central passage 224 in fluid communication with the chamber 210 and the nozzle 184 is defined in the plunger 222. A duckbill check valve 226 is disposed in the central passage 224. The check valve 226 is movable with the plunger 222 which reciprocates in a duty cycle defined by a single upstroke followed by a single downstroke.

The plunger 222 defines at its lower end a piston 228 having first and second flanges 230 and 232, respectively, which flanges 230 and 232 define therebetween an annular recess 234. The side walls of the flanges 230 and 232, respectively, do not contact the inner peripheral side wall 240 of the sleeve 208 so that a gap exists therebetween. A scraper or wiper seal 242, having a generally V-shaped cross-section, is disposed within the recess 234. As seen in FIG. 7, the scraper edge 244 of the seal 242 extends into the gap between the piston 228 and the sleeve 208 and contacts the side wall 240 of the sleeve 208. A compression coil spring 246 is seated on the upper surface of the piston flange 230 so that it is biased between the piston flange 230 and the sleeve flange 212. Openings 248 are provided in the piston 228 to provide fluid communication between the central passage 224 of the plunger 222 and the sleeve chamber 210.

As in the previously described embodiment, initial installation of the soap dispenser includes repeated operation of the pump 154 until the entire fluid conduit 182 and nozzle 184 are filled with soap. Thereafter, the soap dispenser is ready for immediate response by the user. That response is generated by the user placing a hand underneath the spout 150 to break the light beam from the emitter 172 to the detector 176, thereby generating a signal to the circuit board 168 which, in turn, outputs a single pulse to the solenoid 218. That pulse is 0.1 seconds in duration.

Before the solenoid 218 is energized, or in other words when the soap dispenser is not in use, the duckbill check valve 226 is closed and the spring 246 biases the piston 228 downwardly so that it is located at the bottom of the sleeve chamber 210. However, when the solenoid 218 is energized, the duckbill 226 opens as the plunger 222 moves through an upstroke. As shown in FIG. 7, the plunger 222 has begun its upstroke, but the duckbill 226 has not yet opened. As the plunger 222 moves upwardly, a vacuum is created in the lower portion of the chamber 210 beneath the piston 228 which draws liquid soap up the pickup tube 196 from the reservoir 152 and into the lower portion of the chamber 210. As the plunger 222 continues its upstroke, the scraper edge 244 of the wiper seal 242 scrapes the side wall 240 of the sleeve 208 forcing the soap into the upper portion of the chamber 210, which is decreasing in size as the piston 228 continues to move upwardly. The soap is forced through the openings 248 in the plunger piston 228, through the duckbill 226 and into the central passage 224 defined through the plunger 222. Since the central passage 224 and conduit 182 are full of soap already, the additional soap causes a measured quantity of soap to be dispensed from the nozzle 184. As the plunger 222 moves through the downstroke, the duckbill 226 closes and the coil spring 246 biases the plunger 222 downwardly to its rest position creating a vacuum in the upper portion of the chamber 210 above the piston 228 as the upper chamber increases in size. This causes the piston 228 to force the soap in the lower portion of the chamber 210 through the gap between the lower piston flange 232 and the inner wall 240 of the sleeve 208, and because of its flexibility, between the scraper edge 244 of the wiper seal 242 and the wall 240, through the gap between the upper flange 230 and the wall 240 and into the upper portion of the chamber 210. The upper portion of the chamber 210 is again filled with soap and the dispenser is ready to expel soap upon reactivation.

The electronic circuitry described above for the first discussed embodiment of the present invention and schematically illustrated in FIGS. 5 and 6 is the same circuitry employed in this embodiment.

One of the advantages of the present invention, in addition to the dripless immediate response feature, is the fact that the control circuit is activated only once for each time the user places his hand in a position to receive the ejected soap. This prevents multiple delivery of soap reducing waste and maintains cleanliness. The fact that a user need not touch any surface of the dispenser results in improved hygiene and greater user acceptance of the device.

While preferred forms of the invention have been shown and described, it will be understood that modification may be made thereto without departing from the scope of the following claims.

What is claimed is:

1. A liquid dispenser, comprising a spout having a fluid conduit therein, a nozzle attached to the end of the spout and having an orifice in communication with the fluid conduit, said orifice being open in a downwardly facing direction and having at least a gravity-reactive portion of said fluid conduit which is in immediate communication with said nozzle being above said orifice, said nozzle being shaped and dimensioned to avoid dripping of a liquid having a known viscosity in said gravity-reactive portion of said fluid conduit, a liquid reservoir, an electrically-actuated pump in fluid communication with the reservoir and with the fluid conduit, said fluid conduit containing during normal operation of said dispenser a column of liquid continuous from said pump and extending to said nozzle, said pump including a solenoid and a plunger and being adapted to pump liquid from the reservoir to the fluid conduit and out the orifice, means for activating the pump including an electromagnetic energy emitter and an electromagnetic energy detector, one of said emitter and detector being mounted in the spout and the other mounted with the nozzle with the emitter directed toward the detector, and circuit means responsive to the interruption of received light at the detector for activating the pump for a controlled cycle to dispense a measured amount of liquid, whereby the shape of said nozzle supports the weight of the liquid in said gravity-reactive portion of said fluid conduit.

2. The liquid dispenser of claim 1 wherein the pump comprises a housing having said plunger therein, said plunger being reciprocative in a duty cycle including an upstroke to a raised position and a downstroke to a lowered position, and the circuit means activating said plunger for a single duty cycle.

3. The liquid dispenser of claim 2 wherein said housing includes an entry chamber in fluid communication with the fluid reservoir through an inlet, a first check valve disposed in the inlet to permit one way flow of liquid from the reservoir to the entry chamber, said plunger having a central passage therethrough connected to the fluid conduit with a second check valve disposed in the passage to permit one-way flow of liquid from the entry chamber to the plunger passage, one end of the plunger extending into the entry chamber in sealed relation to the chamber such that upon an upstroke of the plunger, the resulting pressure drop in the entry chamber draws liquid from the reservoir through the inlet, past the first check valve and into the entry chamber until the onset of the subsequent downstroke closes the first check valve and results in a pressure rise in the entry chamber to force liquid from the entry chamber past the second check valve, into the plunger passage and fluid conduit and out the orifice.

4. The liquid dispenser of claim 3 wherein the reservoir is lined with a collapsible bag.

5. The liquid dispenser of claim 3 wherein the plunger is biased to its lowered position by a spring and is moved to its raised position by said solenoid.

6. The liquid dispenser of claim 2 wherein the plunger is biased to its lowered position by a spring and is moved to its raised position by a solenoid.

7. The liquid dispenser of claim 1 wherein the reservoir is lined with a collapsible bag.

8. The liquid dispenser of claim 1 wherein the nozzle orifice has an elongated oval shape having a depth, length and width in the ratio of about 5:4:1 for a liquid having a viscosity of at least about 1.5 centipoise.

9. The liquid dispenser of claim 8 wherein the orifice depth is about 0.250 inches, the length is about 0.20 inches, the width is about 0.046 inches and said liquid further comprises liquid soap having a viscosity of at least about 1.5 centipoise.

10. The liquid dispenser of claim 1 wherein the nozzle orifice has an elongated oval shape having a length and width in the ratio of about 4:1 for a liquid having a viscosity of at least about 1.5 centipoise.

11. The liquid dispenser of claim 10 wherein the orifice length is about 0.2 inches and the width is about 0.05 inches.

12. The liquid dispenser of claim 1 wherein the pump comprises a housing having said plunger therein, said plunger being reciprocative in a duty cycle including an upstroke to a raised position and a downstroke to a lowered position, and the circuit means activating said plunger for a single duty cycle, said plunger further including a wiper seal which contacts the side wall of the entry chamber.

13. The liquid dispenser of claim 12 wherein the housing includes an entry chamber in fluid communication with the fluid reservoir through an inlet, said plunger having a central passage therethrough connected to the fluid conduit with a check valve disposed in the passage to permit one-way flow of liquid from the entry chamber to the plunger passage, one end of the plunger extending into the entry chamber in sealed relation to the chamber such that upon an upstroke of the plunger, a vacuum is created in a lower portion of the entry chamber drawing liquid from the reservoir through the inlet into the lower portion of the entry chamber, the check valve opens and the wiper seal scrapes the liquid from the side wall of the entry chamber forcing the liquid into the plunger passage as the size of an upper portion of the entry chamber decreases as the plunger continues its upstroke, the liquid continuing through the fluid conduit and out the nozzle orifice, a subsequent downstroke creating a vacuum in the upper portion of the entry chamber forcing the liquid in the lower portion of the entry chamber into the upper portion of the entry chamber.

14. The liquid dispenser of claim 13 wherein the reservoir is lined with a collapsible bag.

15. The liquid dispenser of claim 13 wherein the plunger is biased to its lowered position by a spring and is moved to its raised position by a solenoid.

16. The liquid dispenser of claim 13 wherein said liquid comprises liquid soap having a viscosity of at least about 1.5 centipoise.

17. The liquid dispenser of claim 16 wherein said nozzle orifice has an elongated oval shape having a depth, length and width in the ratio of about 5:4:1, respectively.

18. The liquid dispenser of claim 12 wherein the plunger is biased to its lowered position by a spring and is moved to its raised position by a solenoid.

19. The liquid dispenser according to claim 12 wherein the housing includes an entry chamber in fluid communication with the fluid reservoir through an inlet, said plunger having a central passage therethrough connected to the fluid conduit with a one-way check valve disposed in the passage for one-way flow of liquid from the plunger passage to the fluid conduit, one end of the plunger extending into the entry chamber in sealed relation to the chamber such that upon an upstroke of the plunger, a vacuum is created in the entry chamber drawing liquid from the reservoir through the inlet into the entry chamber, while at the same time forcing the liquid already in said passage through said plunger central passage, into the fluid conduit and out of the nozzle orifice, a subsequent downstroke of said plunger forcing liquid in the chamber through a lower portion of said central passage of said plunger, the liquid flowing through the lower portion of the passage forcing said one-way check valve open and thus permitting fluid to flow into an upper portion of said plunger passage.

20. The liquid dispenser according to claim 19 wherein said liquid comprises liquid soap having a viscosity of at least about 1.5 centipoise.

21. The liquid dispenser of claim 20 wherein said nozzle orifice has an elongated oval shape having a depth, length and width in the ratio of about 5:4:1, respectively.

22. The liquid dispenser of claim 1 wherein the nozzle is positioned with respect to the spout such that the central axis of the nozzle defines an angle of approximately 60° to the horizontal after installation.

23. The liquid dispenser of claim 1 wherein the nozzle defines a conical rim portion diverging at an angle of approximately 45° from the central axis of the nozzle.

24. The liquid dispenser of claim 23 wherein said rim portion defines an adhesion surface about the inner periphery thereof.

25. The liquid dispenser according to claim 1 wherein said liquid comprises liquid soap.

26. A liquid dispenser for automatically dispensing a measured quantity of liquid to a user, comprising a proximity detection means for sensing the presence of a user in a detection zone at the liquid dispenser, control means responsive to the detection means when a user is detected, said control means including a means for activating a pump for dispensing the measured quantity of liquid and electrical inhibiting means for effectively locking out the operation of the liquid dispenser for a predetermined minimum interval immediately following the dispensing of liquid to the user, said pump including a solenoid and a plunger.

27. A liquid dispenser according to claim 26 wherein said electrical inhibiting means inhibits the activation of the solenoid for said predetermined minimum interval immediately after the solenoid has been activated by said means for activating said pump.

28. A liquid dispenser according to claim 27 wherein said means for activating said pump produces a control pulse of a preset duration for activating the solenoid, and said means for activating said pump includes means for developing an inhibiting pulse immediately following the trailing edge of the control pulse and having a duration equal to the predetermined minimum interval, and wherein said inhibiting pulse is employed to inhibit the activation of the solenoid.

29. A liquid dispenser according to claim 28 wherein said inhibiting pulse prevents the means for activating from producing another control pulse during the predetermined minimum interval.

30. A liquid dispenser according to claim 27 wherein said means for activating said pump produces a pair of time spaced control pulses, each having the same preset duration, for double pulsing the solenoid to energize it twice, thereby to operate the pump twice to dispense two spurts of liquid.

31. A liquid dispenser according to claim 27 wherein the operation of said proximity detection means is inhibited while the solenoid is being energized.

32. A liquid dispenser according to claim 26 wherein said control means is operated to dispense a single spurt of liquid to the user, after which the operation of the liquid dispenser is inhibited for said predetermined minimum interval.

33. A liquid dispenser according to claim 26 wherein said means for activating said pump is operated to dispense a plurality of spurts of liquid to the user, after which the operation of said pump is inhibited for said predetermined minimum interval.

34. A liquid dispenser according to claim 26 wherein said proximity detection means includes an electromagnetic radiation emitter which transmits an electromagnetic radiation beam through the detection zone to an electromagnetic radiation detector, the presence of a user being detected when the electromagnetic radiation beam is broken by the user.

* * * * *